US005143367A

United States Patent [19]

Pottorff

[11] Patent Number: 5,143,367

[45] Date of Patent: Sep. 1, 1992

[54] ROTARY VACUUM WICKETTER WITH REMOVABLE SPLIT WEARPLATES

[76] Inventor: Earl T. Pottorff, 2346 Taylor Rd., Savannah, N.Y. 13146

[21] Appl. No.: 637,682

[22] Filed: Jan. 7, 1991

[51] Int. Cl.[5] ..... B65H 29/24

[52] U.S. Cl. ..... 271/196; 414/27

[58] Field of Search ..... 271/194, 196; 414/27

[56] References Cited

U.S. PATENT DOCUMENTS 4,606,537 8/1986 Achelpohl ..... 271/196
4,877,233 10/1989 Pottorff ..... 271/196
4,954,033 9/1990 Sanders ..... 271/196 X

*Primary Examiner*—Richard A. Schacher
*Attorney, Agent, or Firm*—Wall and Roehrig

[57] ABSTRACT

A rotary vacuum wicketting device has a stationary hub and a rotary hub that has a number of vacuum arms that carry plastic bags or similar work pieces from a first work station to a second work station. Each of the rotary and stationary hubs has a main body portion and a split-disc wear plate, which is formed of a plastic synthetic resin that has been filled with a suitable lubricating agent. The radial arms also each have a removable wear strip carried on a forward surface. The wear plate of the rotating hub has an annular raised surface portion that slidably contacts the facing surface of the stationary hub wear plate.

9 Claims, 3 Drawing Sheets

ROTARY VACUUM WICKETTER WITH REMOVABLE SPLIT WEARPLATES

BACKGROUND OF THE INVENTION

This invention relates to apparatus for handling plastic film articles, and is more particularly directed to apparatus known as a vacuum wicketter, which picks up film articles such as plastic bags on a manufacturing line, and rotates to carry the same to a station where the plastic bags are placed on a wicket. Vacuum is applied to arms of the rotating wicketter at least from the pickup work station to the wicketting work station.

A conventional vacuum wicketter is of aluminum construction, having a two-part hub assembly and a plurality of vacuum arms. The hub assembly has a lower stationary part and an upper rotating part. Both of these are typically formed of cast aluminum. A bearing mounted on the lower stationary part permits rotation of the superposed upper rotating part. One or more vacuum lines are connected to the stationary hub part, and these connect to semi-circular channel that is open on the upper surface of the stationary part.

The rotating hub part carries the vacuum arms which radiate from its circumference at an even spacing. Typically, there are six arms spread at 60 degrees or eight arms spaced at 45 degrees. L-shaped passages in the rotating hub part have one end open to the circumference, which serves as a socket for the male end of the arm, and the other end open to the lower surface to communicate with the vacuum channel in the stationary part. This ensures that vacuum is applied while the respective arms rotate over an angular sector corresponding to the travel between the pickup station and the wicketting work station.

The arms are typically aluminum and generally have a square or rectangular cross section. On each arm, the surface that faces in the direction of rotation has an elongated vacuum channel and a number of apertures or perforations to permit the arm to pick up and carry the plastic bag or other film articles. There is also conventionally a ceramic coating on this surface to withstand wear from friction of the plastic film against the arm.

However, with this construction there are a number of ensuing problems which can lead to breakdowns or to long outages for maintenance. These problems arise largely because of plastic debris and dust which is sucked by the vacuum into the tubular arm, and which can accumulate and clog the apparatus.

The male portions of the all-aluminum wicketter arms have a circular cross section to fit into the sockets which are machined or drilled into the aluminum rotating hub portion. However, the remainder of the arm is of square or rectangular cross section. There are blind pockets where the circular and square cross-sectional portions meet, and these provide sites for collecting the plastic dust and debris. This particulate matter quickly builds up and eventually will clog the arm, so that it will not operate as intended.

These tubular aluminum arms invariably have a plate that is either welded on or formed unitarily at the outer end of the arm, and which closes it off. Therefore, in order to clean dust and debris from the arm, it is necessary to remove the entire arm from the rotor hub. This takes considerable time and skill.

Furthermore, the ceramic surface on the aluminum arms eventually will wear off. At that point, the entire arm has to be removed and replaced, with the original arm being sent out for resurfacing. This is a rather expensive process, and there is significant down time for the arms to be removed and replaced.

Still another drawback with the conventional wicketter is that the two-part hub requires an additional bearing member between the stationary and rotating hub portions. This bearing can wear out, and it is difficult and time consuming job to replace it.

An improved rotary vacuum wicketter is disclosed in my earlier U.S. Pat. No. 4,877,233, granted Oct. 31, 1989. In that device, both the rotary and stationary hubs are molded of a plastic synthetic resin which has been filled with a suitable lubricating agent. The sockets for the radial arms can be formed of square cross section, so that the arms themselves can be tubes of uniform, square cross section. This avoids the blind corners of the prior art, and thus avoids the problem of clogging described earlier. The arms themselves can have a detachable and replaceable plastic wear plate screwed or otherwise fastened on, thus avoiding the expense and delays associated with resurfacing. In addition, the tubular arms have detachable end caps which permit cleaning and servicing of the arms without removal from the rotary hub.

However, the rotary and stationary hub portions are each one-piece members. When the facing surfaces become worn to the point where surface refinishing or replacement of the hub portions becomes necessary, then it is necessary to remove one or both of the rotary and stationary hub portions from the axial spindle, which involves significant machine down-time. Also, if wear is significant, the entire hub portion may need to be replaced.

In addition, the system of U.S. Pat. No. 4,877,233 requires special clamps to hold the arms in place on the hub and the square-cross section L-shaped channels in the rotary hub portion are somewhat difficult to mold, although these are certainly less difficult to create them similar shaped machined channels in the all-aluminum hubs.

OBJECTS AND SUMMARY OF THE INVENTION

Accordingly, it is one object of this invention to provide an improved vacuum wicketter which avoids the aforementioned drawbacks of the prior art.

It is another object of this invention to provide a vacuum wicketter which is easier and faster to service.

It is a further object of this invention to provide a wicketter in which the arms are more readily removable from the hub.

It is a still further object of this invention to provide a wicketter in which the hub portions are formed of two or more parts to facilitate forming of the various vacuum channels.

In accordance with an aspect of this invention, rotary vacuum wicketter apparatus are provided for picking up and carrying flat film workpieces from a first work station to place the workpieces on a wicket at a second work station. A vacuum hub assembly is formed of a stationary hub and a rotary hub superimposed on one another with the same horizontal axis. The stationary hub has a vacuum channel permitting vacuum to be applied over a predetermined angular portion of the superposed rotary hub. The rotary hub has a circular or axial surface facing an upper surface of the stationary hub, and has a plurality of spaced sockets in its circumferential or peripheral surface and which also penetrate to the axial surface to communicate with the vacuum channel. A plurality of radial arms are mounted in the rotary hub, and project radially outward from it. Each of the arms is in the form of a tube that is closed at its radially outward end, and with a male portion at its radially inward end which fits into a respective one of the rotary hub sockets. Each arm has a flat longitudinal face situated on the side that faces in the rotation direction. This face is provided with perforations through it so that the arm can pick up and carry the workpieces by vacuum from the first work station to the second work station.

This vacuum wicketting apparatus has a number of features which constitute improvements over the conventional wicketter as described above.

In the wicketting apparatus of this invention, each arm is of a uniform internal cross section from the radial outward end to and including the male portion, so that blind pockets are avoided. This minimizes the likelihood for dust to accumulate within the arm. The arms can each include a removable flat wear plate attached adhesively, e.g. by cement or by double-faced adhesive tape, to the longitudinal flat forward-facing surface of the arm.

The upper hub and the lower hub are preferably molded at least in part from a semi-rigid plastic synthetic resin, such as Delrin, which is an acetal homopolymer. This material is preferably impregnated with a lubricating agent, so that a portion of the upper and lower hubs can itself serve as a bearing surface, thereby avoiding the need for a separate bearing.

Here, each of the upper and lower hubs i.e., the rotary hub and the stationary hub, comprises a main body portion and a wear plate disc that is removably bolted onto it. The two wear plate discs face each other in sliding rotary engagement, and each is formed of a plastic synthetic resin of the type mentioned above and filled with a lubricating agent.

The square or rectangular cross section sockets for the arms are formed of cutouts or recesses in the rotary hub body, defining three walls of the socket, and with the wear plate disc of the rotary hub defining the fourth wall for each of the sockets.

The wear plates are preferably formed of two mating semi-circular or half-disc plate portions, although a larger number of arcuate segments could be used. These are each joined to the respective hub portion body by bolts or machine screws. These can be removed from the hub portion bodies and replaced without need of removing the bodies from the spindle.

The above and many other objects, features, and advantages of this invention will be more fully understood from the ensuing description of a preferred embodiment, when read in connection the accompanying Drawing.

DETAILED DESCRIPTION OF THE PREFERRED EMBODIMENT

Figure 1:
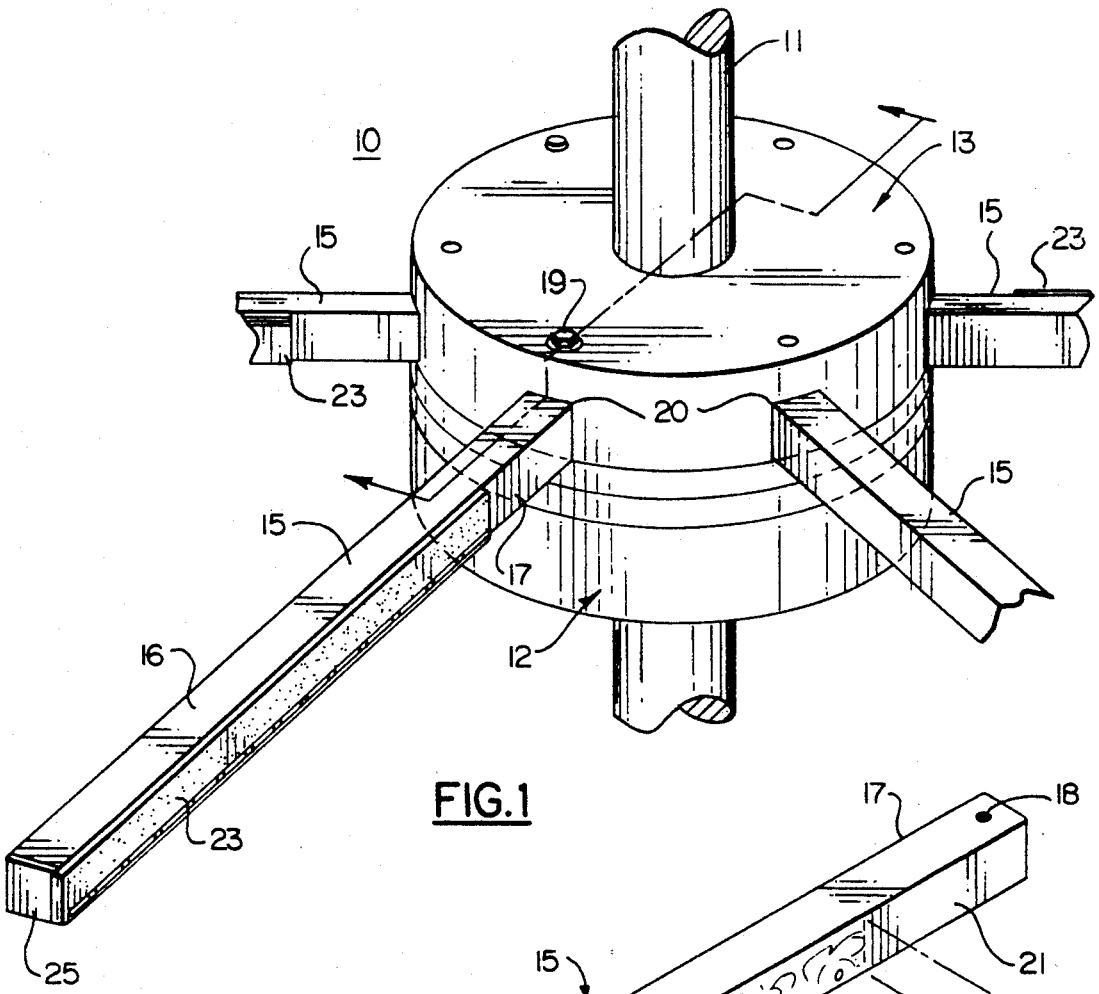
FIG. 1 is a perspective view of a vacuum wicketting device according to this invention.

With reference to the Drawing, and initially to FIG. 1, a vacuum wicketting device 10 has a rotating shaft or spindle 11 which passes through an opening in a stationary hub 12 and rotates a rotating hub 13. The shaft can be disposed horizontally or vertically depending on the manufacturing design. Vacuum lines (not shown) connect to appropriate ports in the lower hub 12. A plurality of arms 15 radiate outward from the rotating hub and as these arms 15 rotate, they pick up plastic polyethylene film bags from a pickup station and place them on a wicket at a second station. The arms 15 carry the plastic bags or other articles by vacuum from the first work station to the second work station.

The vacuum pickup arms 15 are formed of tubes of generally square or rectangular cross section, with a tubular outer portion 16 and a male portion 17. The male portion has an opening 18 to receive a bolt 19 which holds it in place in a socket 20 formed in the hub 13, the socket 20 being also of square or rectangular cross section. In this case, there are six of the vacuum arms spaced at 60 degrees; however, in other embodiments, another arrangement such as eight arms spaced at 45 degrees could be employed.

Figure 2:
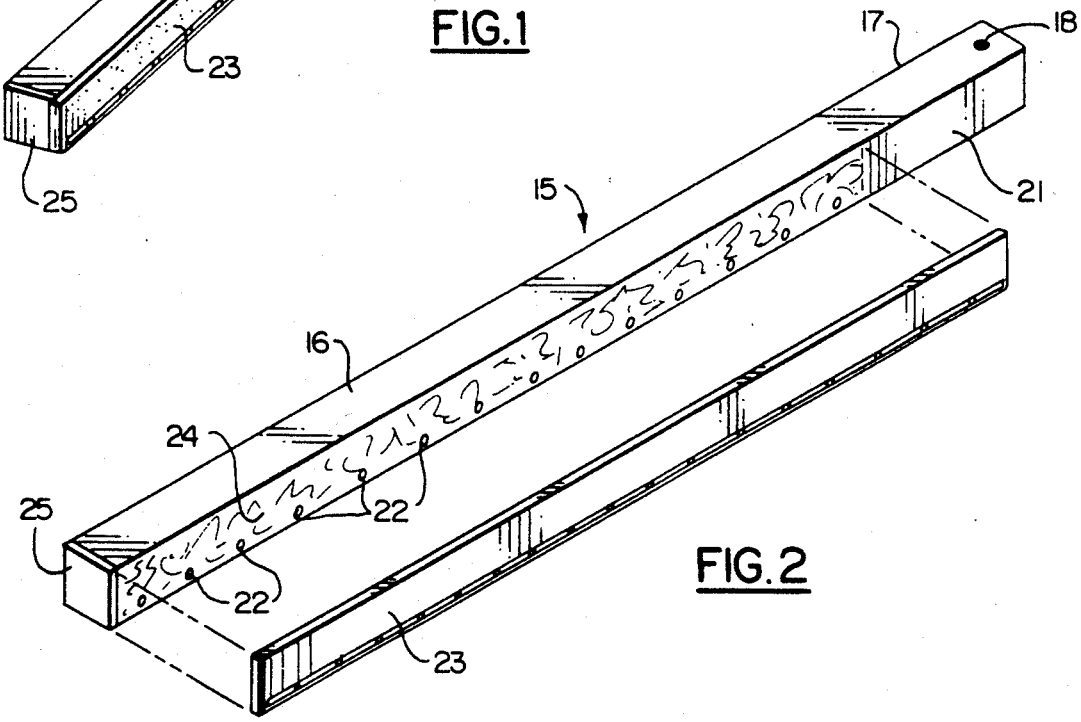
FIG. 2 is a perspective view of one of the radial arms, featuring the removable wear plate.

As shown in FIG. 2, a forward face 21 of the outer portion 16 of the arm has a series of perforations 22 along one side. A removable wear strip 23 can be formed of a plastic synthetic resin, for example acetal homopolymer, such as Delrin, with a lubricant filler. The strip 23 is attached onto the forward face of the arm, in this case with a double-sided adhesive tape 24 or another suitable adhesive. The wear strip 23 has a series of perforations which match those in the tubular outer portion 16 of the pickup arm. A square end-plug 25 preferably also formed of a plastic resin closes off the radially outer end of the arm 15.

Figure 3:
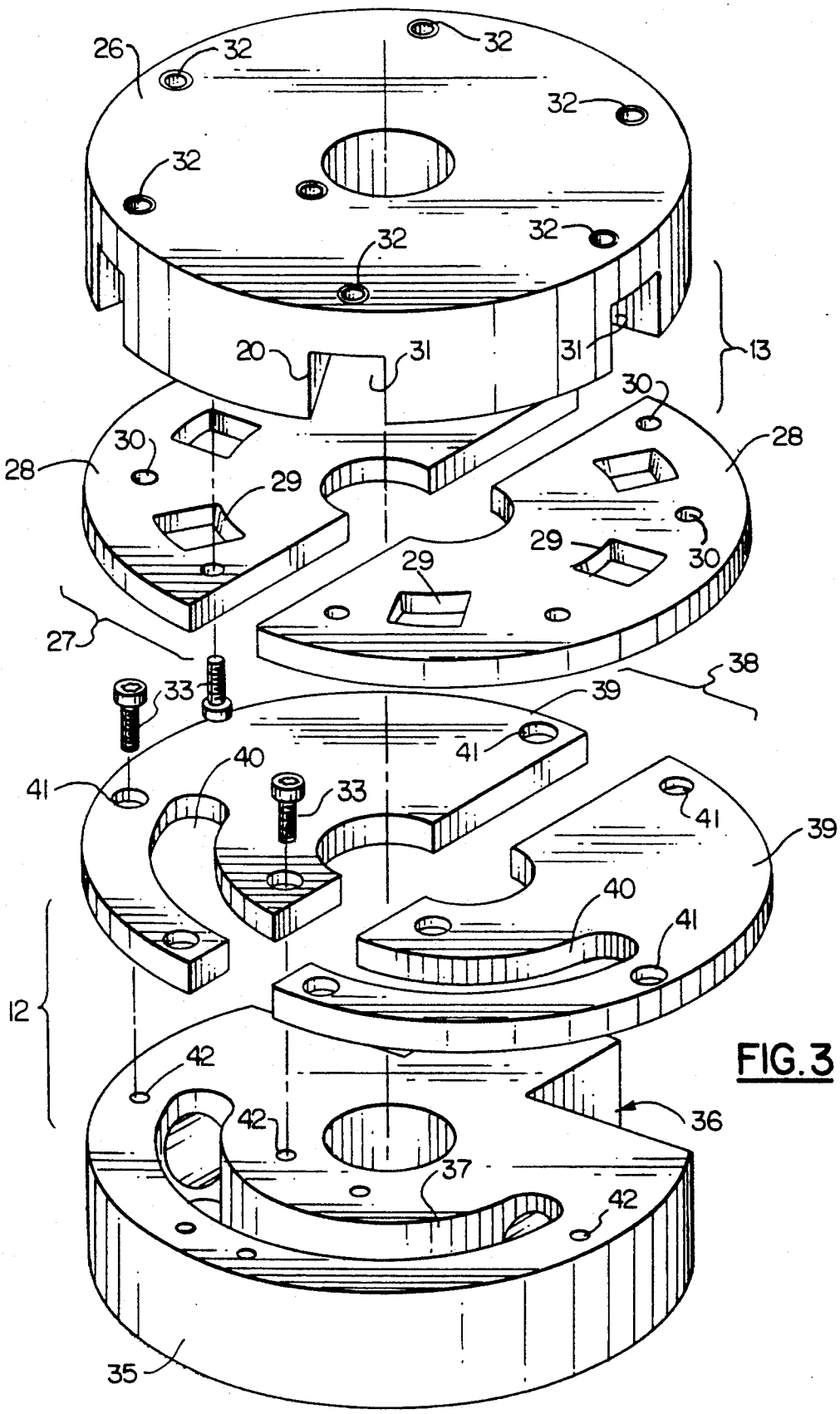
FIG. 3 is an exploded assembly view of the hub of the vacuum wicketting device of one embodiment of this invention.
Figure 4:
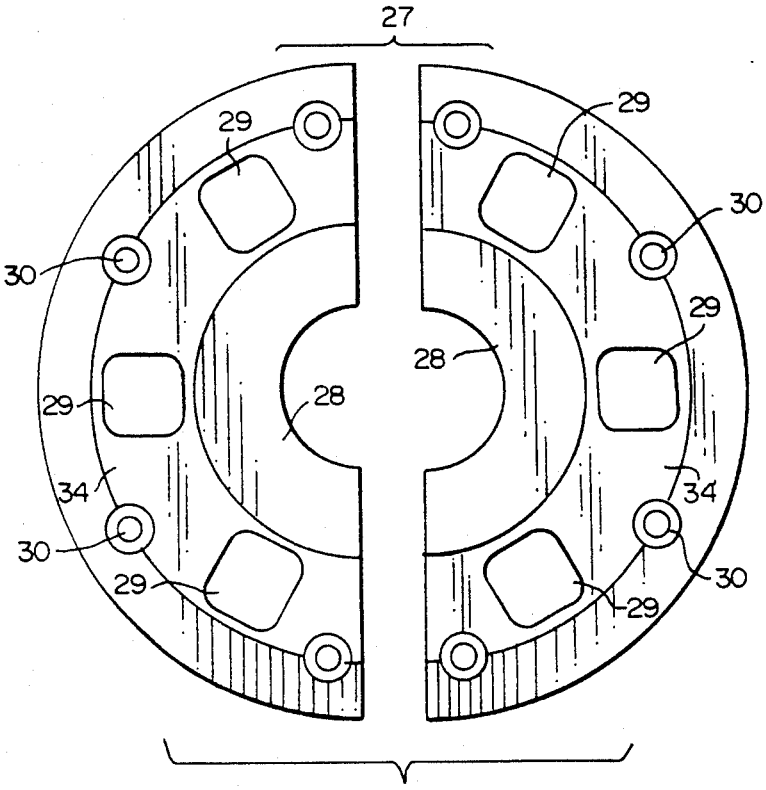
FIG. 4 is a plan view of the split disc wear plate of the rotary hub of said one embodiment of this invention.
Figure 5:
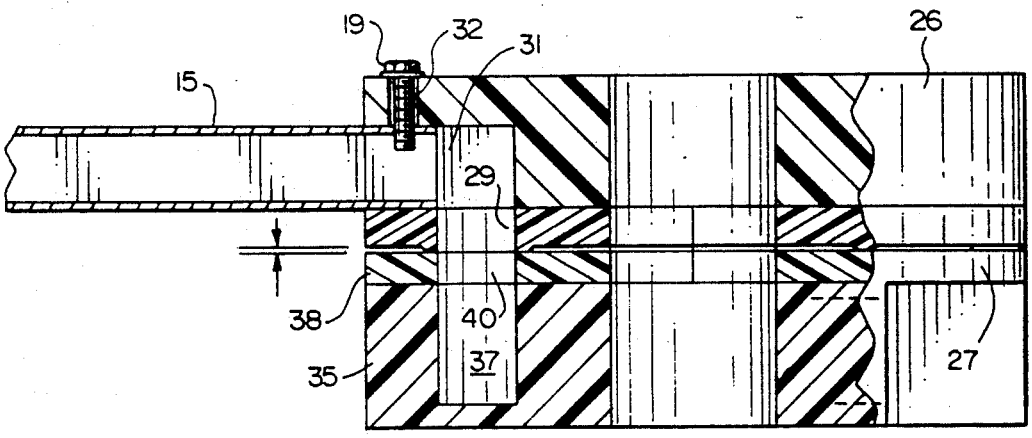
FIG. 5 is a partial sectional elevation taken at 5—5 of FIG. 1.

The stationary and rotating hubs 12 and 13 are of multiple-part construction as shown e.g., in FIGS. 3–5.

The rotating hub 13 has a body portion 26 and a wear plate disk 27 removable attached onto it. The body portion 26 can be of any suitable material, but in this embodiment is conveniently molded of a plastic synthetic resin. The wear plate 27 is preferably formed of a semi-rigid plastic synthetic resin such as Delrin, and filled with a lubricant additive.

As shown in FIGS. 3 and 4, the wear plate 27 is formed of two semi-circular sections 28 which are substantially mirror images of one another. Each section 28 has three square openings 29 spaced 60 degrees apart, and suitably located bolt holes 30 which are countersunk on one side, as shown in FIG. 4.

The body portion 26 of the rotating hub 13 is provided with six cutouts 31 which extend from the periphery along a lower wall. These cutouts 31 are of square or rectangular cross section, and these define three sides of the respective sockets 20, with a flat surface of the associated wear plate 27 defining the fourth side of the socket. Threaded bushings 32 are sunk into the body portion 26 above each of the sockets 20 to receive the respective bolts 19 that retain the arms 15 in place, as shown e.g. in FIG. 5.

As shown in FIG. 4, the lower face of the wear plate 27 has a raised annular surface 34 which contains the square opening 29. This annular surface 34 stands off above the remaining portions of the surface. That is, the parts of the lower face of the semi-circular sections 28 that are radially beyond and radially within the limits of the annular surface 34 are sunk a small amount, here about five mils (0.005 inches).

The stationary hub 12, as also shown in FIG. 3, comprises a body portion 35 having cutouts 36 to facilitate vacuum connection, and the cutouts 36 lead to a semicircular cutout 37 for applying vacuum to the arms 15 over approximately 180 degrees of rotation. The hub 12 also comprises a wear plate 38 in the form of a disk made of acetal homopolymer or other suitable plastic synthetic resin filled with a suitable lubricant. The wear plate 38 is formed of two semi-circular portions 39 which are mirror images of one another. The wear plate 38 has a cutout 40 which is semicircular in form and substantially matches the cutout 37 in the body portion 35. There are also a number of countersunk bolt holes 41 which align with matching bolt holes 42 in the body portion 35. This facilitates the attachment of the two semicircular portions 39 to the stationary hub body portion by means of bolts 33.

As shown in FIG. 5, a vacuum path from one typical arm 15 includes an L-shaped channel that includes the cutout 31 in the body portion 26 and the square opening 29 in the wear plate 27. This connects through the semicircular openings 40 and 37 to the vacuum lines (not shown). As also shown, the raised annular surface 34 is in rotationally slidable contact with the upper surface of the stationary hub wear plate 38. This limits frictional contact between the two hubs 12 and 13 to the relatively narrow contact area defined by the annular surface 34.

The vacuum wicketting device of this invention is of simple construction, and can be readily manufactured. The device can be field maintained by the operator without special skill or training. The split wear-plate disks 27 and 38 can be replaced, when need be, by separating the rotating hub 13 along the spindle a short distance from the stationary hub 12, and then simply removing the bolts 33 to remove the semi-circular wear plate sections 28 and 39 from around the spindle 11. These can then be replaced easily with fresh wear plate sections 28, 39, which can then be readily reattached using the bolts 33. While it is not difficult to withdraw the bolt 19 and remove the entire arm 15, it is usually unnecessary to do. Instead, the wear plate strip 23 can be removed and a new one attached with a strip of double sided adhesive tape or an adhesive paste or liquid. Thus, replacement of the portions of the machine which absorb the wear, namely the wear strip 23 and the wear plates 27 and 38, can be quickly removed and replaced without difficulty, and without need to dismantle the apparatus. With this construction, there is minimal downtime for servicing the apparatus and replacing worn parts. Furthermore, replacement components are low-cost, thereby further reducing maintenance cost for the apparatus. The internal shape of the arms and openings within the hubs 12 and 13 minimizes the clogging that can result from dust particles.

While this invention has been described in detail with reference to a single preferred embodiment, it should be understood that the invention is not limited to that precise embodiment. Rather, many modifications and variations can be carried out by those skilled in the art without departing from the scope and spirit of this invention as defined in the appended claims.

What is claimed is:

1. Rotary vacuum pickup apparatus for carrying flat workpieces from a first work station and placing the workpieces on a wicket at a second work station comprising:

a vacuum hub assembly formed of a stationary hub and a rotary hub superposed on one another and having a common axis, the stationary hub including vacuum channel means for applying vacuum over a predetermined angular portion of the superposed rotary hub, and the rotary hub having a peripheral surface, an axial surface in communication with the vacuum channel means of the stationary hub, and a plurality of spaced sockets which penetrate to said axial surface to communicate with said vacuum channel means; and a plurality of radial arms mounted in the rotary hub and projecting radially outward therefrom, each said arm including a tube closed at its radially outward end, having a male portion at its radial inward end which fits into a respective one of said sockets and having a flat longitudinal face on the side that faces in the rotation direction of said rotary hub and which is provided with perforations therethrough so that the arm can carry said workpieces by vacuum from the first work station to said second work station;

comprising the improvement wherein said stationary hub and said rotary hub each include a body portion and a wear-plate portion removably attached thereto, said stationary hub and rotary hub wear plate portions being in rotational sliding contact with one another, and each said wear plate portion being formed of a semi-rigid plastic synthetic resin material which has been impregnated with a lubricating agent.

2. The rotary vacuum pickup apparatus of claim 1 wherein the male portions of said arms are of rectangular cross section, and said sockets are of a mating rectangular cross section, with a cutout in the rotary hub body portion defining three flat sides of each socket and the wear plate defining a fourth flat side thereof.

3. The rotary vacuum pickup apparatus of claim 1 wherein each said wear plate portion is in the form of an apertured disc formed of mating semicircular portions.

4. The rotary vacuum pickup apparatus of claim 1 wherein said vacuum hub assembly includes a spindle on said common axis and passing through both said stationary hub and said rotary hub and each of said wear plate portion is in the form of an apertured disc formed of a plurality of mating arcuate sections removably fastened onto the respective body portion, such that said wear plate portions can be installed onto the respective body portions or removed therefrom without removing the associated body portions from the spindle.

5. The rotary vacuum pickup apparatus according to claim 1 wherein the wear plate portion of said rotary hub includes a facing surface that has an annular surface portion containing apertures which lead into respective ones of said sockets, and which is in sliding contact with the wear plate portion of said stationary hub, and with the remainder of the facing surface of said rotary hub wear plate portions that are respectively disposed radially beyond the annular surface portion and radially therewithin being recessed below said annular surface.

6. The rotary vacuum pickup apparatus according to claim 5 wherein said remainder of said facing surface is recessed substantially 0.005 inches below said annular surface portion.

7. The rotary vacuum pickup apparatus according to claim 1 wherein said radial arms each have a replaceable wear plate secured onto the associated flat longitudinal face, said replaceable wear plate being molded of a semi-rigid plastic synthetic resin which has been impregnated with a lubricating agent.

8. The rotary vacuum pickup apparatus according to claim 7 wherein said radial arms each include an adhesive means disposed between the flat longitudinal face and its associated wear plate for removably securing the latter to its associated arm.

9. The rotary vacuum pickup apparatus according to claim 1 wherein said rotary hub body portion includes a plurality of threaded bores disposed one at each socket, and a plurality of threaded fasteners in said sockets which engage the associated bore and penetrate the male portion of the rotary arm in the respective socket for holding the arms in place in their associated sockets.

* * * * *